US008175479B2

(12) United States Patent
Saeki et al.

(10) Patent No.: US 8,175,479 B2
(45) Date of Patent: May 8, 2012

(54) TRANSFER DEVICE AND IMAGE FORMING APPARATUS HAVING FIRST AND SECOND TRANSFER NIPS AND FIRST AND SECOND CONTACTING MEMBERS WHICH APPLY TRANSFER BIASES

(75) Inventors: Kazuchika Saeki, Kanagawa (JP); Toshitaka Yamaguchi, Kanagawa (JP); Masaharu Furuya, Kanagawa (JP); Takahiro Nakayama, Kanagawa (JP); Takuya Sekine, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/041,034

(22) Filed: Mar. 4, 2011

(65) Prior Publication Data

US 2011/0150540 A1 Jun. 23, 2011

Related U.S. Application Data

(63) Continuation of application No. 11/933,693, filed on Nov. 1, 2007, now Pat. No. 7,929,877.

(30) Foreign Application Priority Data

Nov. 21, 2006 (JP) ..... 2006-314203

(51) Int. Cl.
*G03G 15/16* (2006.01)
*G03G 15/01* (2006.01)

(52) U.S. Cl. ..... 399/66; 399/302

(58) Field of Classification Search ..... 399/66, 399/88, 298, 302

See application file for complete search history.

(56) References Cited

U.S. PATENT DOCUMENTS

| | | | | |
|---|---|---|---|---|
| 6,336,025 | B1 | 1/2002 | Saeki | |
| 6,405,002 | B2 * | 6/2002 | Ogiyama et al. | 399/302 |
| 6,904,255 | B2 | 6/2005 | Kera et al. | |
| 7,277,657 | B2 | 10/2007 | Uchida et al. | |
| 7,277,667 | B2 | 10/2007 | Saito et al. | |
| 7,486,900 | B2 | 2/2009 | Omata | |
| 7,639,975 | B2 * | 12/2009 | Ishida | 399/302 |
| 2005/0078991 | A1 | 4/2005 | Kimura et al. | |
| 2006/0056884 | A1 | 3/2006 | Sawai et al. | |
| 2006/0210307 | A1 | 9/2006 | Katoh et al. | |
| 2006/0210324 | A1 | 9/2006 | Kuma et al. | |
| 2006/0284958 | A1 | 12/2006 | Saeki et al. | |
| 2006/0285973 | A1 | 12/2006 | Keller | |
| 2007/0098472 | A1 | 5/2007 | Saeki et al. | |

(Continued)

FOREIGN PATENT DOCUMENTS

CN 1115879 A 1/1996

(Continued)

*Primary Examiner* — William J Royer
(74) *Attorney, Agent, or Firm* — Oblon, Spivak, McClelland, Maier & Neustadt, L.L.P.

(57) ABSTRACT

An image forming apparatus includes an intermediate transfer belt, a photosensitive belt, a primary transfer roller, a secondary-transfer opposing roller, and a secondary transfer roller. The photosensitive belt comes into contact with a surface of the intermediate transfer belt to form a primary transfer nip. The secondary-transfer opposing roller comes into contact with the surface of the intermediate transfer belt to form a secondary transfer nip. The closest distance between a surface of the photosensitive belt and that of the primary transfer roller is greater than the thickness of the intermediate transfer belt. A toner image on the intermediate transfer belt is transferred onto a recording sheet at the secondary transfer nip while a transfer bias is applied to the secondary transfer roller.

14 Claims, 4 Drawing Sheets

U.S. PATENT DOCUMENTS

| | | | |
|---|---|---|---|
| 2007/0110464 | A1 | 5/2007 | Nakayama et al. |
| 2007/0127947 | A1 | 6/2007 | Kuma et al. |
| 2007/0127955 | A1 | 6/2007 | Katoh et al. |
| 2011/0013950 | A1 | 1/2011 | Furuya et al. |

FOREIGN PATENT DOCUMENTS

| | | | |
|---|---|---|---|
| CN | 1497389 | A | 5/2004 |
| JP | 5-11562 | | 1/1993 |
| JP | 05-127546 | | 5/1993 |
| JP | 2001-134109 | | 5/2001 |
| JP | 2001-296760 | | 10/2001 |
| JP | 2002-148898 | | 5/2002 |
| JP | 2003-043783 | | 2/2003 |
| JP | 2004-109575 | | 4/2004 |
| JP | 2004-142920 | | 5/2004 |
| JP | 2005-352041 | | 12/2005 |
| JP | 2006-018177 | | 1/2006 |
| JP | 2006-65113 | | 3/2006 |
| JP | 2006-154233 | | 6/2006 |
| WO | WO 02/069056 | A1 | 9/2002 |
| WO | WO 02/099536 | | 12/2002 |

* cited by examiner $$SF1 = \frac{(MXLNG)^2}{AREA} \times \frac{\pi}{4} \times 100$$

$$SF2 = \frac{(PERI)^2}{AREA} \times \frac{1}{4\pi} \times 100$$

TRANSFER DEVICE AND IMAGE FORMING APPARATUS HAVING FIRST AND SECOND TRANSFER NIPS AND FIRST AND SECOND CONTACTING MEMBERS WHICH APPLY TRANSFER BIASES

CROSS-REFERENCE TO RELATED APPLICATIONS

The present application is a continuation of U.S. application Ser. No. 11/933,693 filed on Nov. 1, 2007 now U.S. Pat. No. 7,929,877, which claims priority to Japanese priority document, 2006-314203 filed in Japan on Nov. 21, 2006, the entire contents of each of which are incorporated herein by reference.

BACKGROUND OF THE INVENTION

1. Field of the Invention

The present invention relates to a transfer device, and an image forming apparatus.

2. Description of the Related Art

Tandem-drum image forming apparatuses and single-drum image forming apparatuses have been known. For example, Japanese Patent Application Laid-Open No. 2004-142920 discloses a tandem-drum image forming apparatus that includes a plurality of image carriers, such as photosensitive members. The image carriers are brought into contact with a surface of an endless intermediate transfer belt to form a plurality of primary transfer nips. In one of the primary transfer nips at which a first primary transfer process is performed, a toner image on an image carrier is transferred onto a surface of the intermediate transfer belt on which no image is transferred yet. In contrast, at the other primary transfer nips, a toner image on the image carrier is primary-transferred onto the already-transferred toner image on the intermediate transfer belt to thus be superimposed thereon. Through such a superimposing primary transfer process, a superimposed toner image is formed on the intermediate transfer belt. The superimposed toner image is collectively secondary-transferred onto a recording medium (e.g., recording sheet) nipped in a secondary transfer nip formed as a contact portion between the intermediate transfer belt and, e.g., a roller.

On the other hand, Japanese Patent Application Laid-Open No. 2004-109575 discloses a single-drum image forming apparatus that includes only one image carrier. The image carrier is brought into contact with a surface of an endless intermediate transfer belt to form a primary transfer nip. During a period in which the intermediate transfer belt rotates a plurality of times, toner images formed on the image carrier are transferred onto the intermediate transfer belt to thus be superimposed one upon another on the intermediate transfer belt. When a superimposed toner image is formed on the intermediate transfer belt, a shifting mechanism that brings a roller member or the like into and out of contact with the intermediate transfer belt is actuated so that the roller member is brought into contact therewith to form a secondary transfer nip. The superimposed toner images on the intermediate transfer belt are collectively secondary-transferred onto a recording medium nipped in the secondary transfer nip.

In the conventional technologies described above, toner images superimposed in multiple layers pass through the primary transfer nip in the primary transfer process. This poses a problem that an overpressure is undesirably applied to the multi-layered toner images, which induces a defect related to superimposing transfer such as a void.

Moreover, moisture absorption by a recording medium is likely to induce defective secondary transfer. More specifically, a recording medium made of fiber or the like absorbs moisture under an environment of high temperature and high humidity, resulting in less electric resistance across the recording medium. When the recording medium of the thus-decreased resistance is nipped in the secondary transfer nip formed as a contact portion between the intermediate transfer belt and a roller member to which a secondary transfer bias is applied, a transfer current undesirably flows to the ground via the roller member, the recording medium, a guide member contacting the recording medium, and the like. Thus, the transfer current supplied from the roller member to the intermediate transfer belt becomes undercurrent, thereby causing defective secondary transfer.

SUMMARY OF THE INVENTION

It is an object of the present invention to at least partially solve the problems in the conventional technology.

A transfer device includes an intermediate transfer member that moves endlessly; an image carrier that comes into contact with an outer surface of the intermediate transfer member to form a first transfer nip; a first contacting member that is applied with a first transfer bias and that comes in contact with an inner surface of the intermediate transfer member in the first transfer nip or near the first transfer nip; a second transfer nip forming member that comes into contact with the outer surface of the intermediate transfer member to form a second transfer nip; and a second contacting member that is applied with a second transfer bias and that comes into contact with the inner surface of the intermediate transfer member in the second transfer nip or near the second transfer nip, wherein a closest distance between a surface of the image carrier and a surface of the first contacting member is greater than a thickness of the intermediate transfer member, and a toner image on the image carrier is transferred directly onto the intermediate transfer member, or transferred onto a toner image that has already been transferred onto the intermediate transfer member to form a superimposed toner image on the intermediate transfer member, and the superimposed toner image on the intermediate transfer member is transferred onto a recording medium at the second transfer nip.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
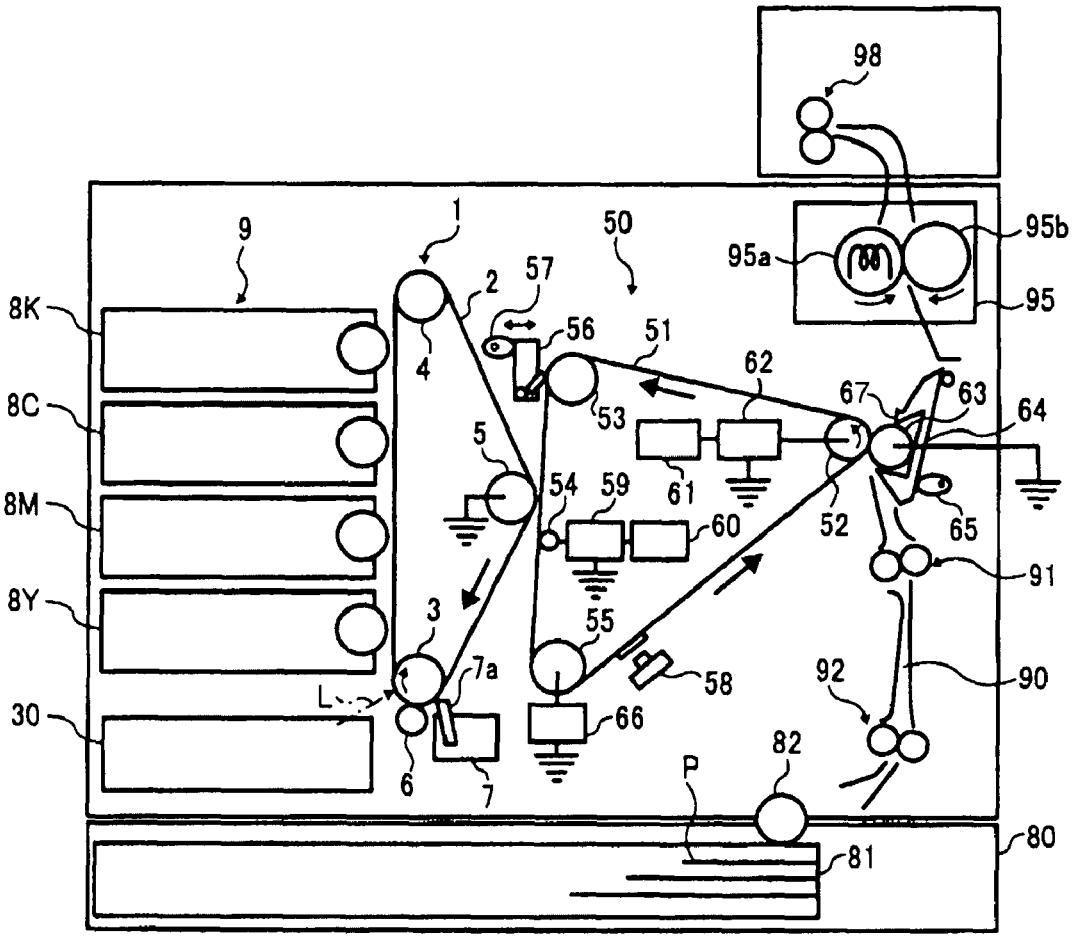
FIG. 1 is a schematic diagram of an image forming apparatus according to an embodiment of the present invention.

FIG. 1 is a schematic diagram of an electrophotographic printer (hereinafter, "printer") as an image forming apparatus according to an embodiment of the present invention. The printer includes a photosensitive belt 1, a developing device 9, an optical writing unit 30, a transfer unit 50, a sheet feeder 80, a sheet feed path 90, a registration roller pair 91, a fuser 95, and a sheet-discharge roller pair 98. The printer superimposes toner images of yellow (Y), magenta (m), cyan (C), and black (K) colors one upon another, thereby forming a full-color image.

The photosensitive belt 1 includes an endless photosensitive belt 2, a drive roller 3, a tension roller 4, a primary-transfer-nip backup roller 5, a charging roller 6, and a photosensitive-member cleaning unit 7. The photosensitive belt 2 extends around the drive roller 3, the tension roller 4, and the primary-transfer-nip backup roller 5. A drive unit (not shown) rotates the drive roller 3 clockwise, thereby rotating the photosensitive belt 2 clockwise in FIG. 1.

The photosensitive belt 2 is made of an endless belt having a surface (front face) covered with a photosensitive layer. The charging roller 6 rotated by a drive unit (not shown) is in contact with a portion of the photosensitive belt 2 at which the photosensitive belt 2 is in contact with the drive roller 3. A charging bias is applied to the charging roller 6 from a power supply (not shown). This causes discharge to occur between the charging roller 6 and the front face of the photosensitive belt 2, thereby electrically charging the photosensitive layer on the photosensitive belt 2 uniformly, e.g., negatively, at a portion between the photosensitive belt 2 and the charging roller 6 or in its neighborhood.

The optical writing unit 30 is located at a downwardly leftward position relative to the photosensitive belt 2 in FIG. 1. The optical writing unit 30 optically scans the photosensitive layer of the photosensitive belt 2, which has been uniformly charged, with a laser beam L emitted from a laser diode based on image data supplied from a personal computer (not shown) or the like. An electrostatic latent image is thus formed on the photosensitive layer. Other types of optical writing units can be used for optical scanning using, for example, a light-emitting diode (LED) array.

The transfer unit 50 causes an endless intermediate transfer belt 51 to endlessly move at a linear velocity of 150 mm/sec, and is located to the right of the photosensitive belt 2 in FIG. 1. A surface (front face) of the intermediate transfer belt 51 is brought into contact with a portion of the photosensitive belt 2 at which the primary-transfer-nip backup roller 5 is wound around by the photosensitive belt 2 to form a primary transfer nip.

The photosensitive belt 2 endlessly moves at a linear velocity of 150 mm/sec on an orbit along which the photosensitive belt 2 is moved on a left-side stretched face of the photosensitive belt 2 approximately vertically upward in FIG. 1. The developing device 9 that includes vertically-arranged developing units 8Y, 8M, 8C, and 8K is located to the left of the left-side stretched face in FIG. 1. Each of the developing units 8Y, 8M, 8C, and 8K is individually brought into and out of contact with the photosensitive belt 2 by corresponding one of shifting mechanisms (not shown).

In the printer, development with four colors: Y, M, C, and K is performed on the photosensitive belt 2 over a period during which the photosensitive belt 2 rotates four times. More specifically, first, the optical writing unit 30 optically scans the surface of the photosensitive belt 2 having been uniformly negatively charged to approximately 500 volts with the charging roller 6 to form an electrostatic latent image for Y thereon. While the photosensitive belt 2 endlessly moves with only the developing unit 8Y among the four developing units 8Y, 8M, 8C, and 8K brought in contact with the photosensitive belt 2, the developing unit 8Y develops the electrostatic latent image into a Y-toner image. A negative developing bias applied to a developing roller of the developing unit 8Y is approximately 300 volts. The Y-toner image is caused to advance into the primary transfer nip as the photosensitive belt 2 rotates, and primary-transferred from the photosensitive belt 2 to the intermediate transfer belt 51. Transfer residual toner remaining on the surface of the photosensitive belt 2 past through the primary transfer nip is scraped off by a cleaning blade 7*a* in the photosensitive-member cleaning unit 7.

The surface of the photosensitive belt 2 having been cleaned is uniformly negatively charged to 500 volts again by the charging roller 6. The optical writing unit 30 optically scans the surface of the photosensitive belt 2 having been uniformly negatively charged to form an electrostatic latent image for M thereon. While the photosensitive belt 2 endlessly moves with only the developing unit 8M among the four developing units 8Y, 8M, 8C, and 8K brought into contact therewith, the developing unit 8M develops the electrostatic latent image into an M-toner image. Circular movement of the photosensitive belt 2 causes the M-toner image to advance into the primary transfer nip. Simultaneously, circular movement of the intermediate transfer belt 51 causes the Y-toner image having been transferred onto the intermediate transfer belt 51 in advance to advance into the primary transfer nip. The M-toner image on the photosensitive belt 2 is superimposed and primary-transferred onto the Y-toner image.

Thereafter, as in the case of the M-toner image, a C-toner image and a K-toner image are sequentially formed on the photosensitive belt 2, and superimposed on the superimposed Y- and M-toner images on the intermediate transfer belt 51 and primary-transferred thereto in the primary transfer nip. Thus, a four-color-superimposed toner image is eventually formed on the intermediate transfer belt 51.

In addition to the intermediate transfer belt 51, the transfer unit 50 includes a secondary transfer roller 52, a tension roller 53, a primary transfer roller 54, a grounded roller 55, a belt cleaner 56, a first eccentric cam 57, a mark sensor 58 made of a reflective photo sensor, a primary-transfer-bias power supply 59, a primary-transfer bias controller 60, a secondary-transfer bias controller 61, a secondary-transfer-bias power supply 62, a secondary-transfer opposing roller 63, an opposing roller support 64, a second eccentric cam 65, and an ammeter 66. The intermediate transfer belt 51 extends around the secondary transfer roller 52, the tension roller 53, the primary transfer roller 54, and the grounded roller 55. A drive unit (not shown) rotates the secondary transfer roller 52 counterclockwise in FIG. 1, thereby causing the intermediate transfer belt 51 to endlessly rotate counterclockwise in FIG. 1.

The intermediate transfer belt 51 is an endless belt made of a material obtained by dispersing a conductive material, such as carbon black, in polyvinylidene fluoride (PVDF), polyethylene-tetrafluoroethylene (ETFE), polyimide (PI), polycarbonate (PC), or a like material. A surface (front face) of the belt can be covered with a surface layer made of a conductive material.

When such a belt covered with the surface layer is employed as the intermediate transfer belt 51, a material that exhibits a toner releasing property superior to that of the belt is desirably used as a material of the surface layer. Examples of such a material include fluorine resins such as ETFE, polytetrafluoroethylene (PTFE), PVDF, a perfluoro-alkoxy-fluoro resin (PEA), a fluorinated ethylene propylene copolymer (FEP), and vinyl fluoride (PVF).

Example manufacturing methods for the intermediate transfer belt 51 include mold casting and centrifugal casting. The surface of the intermediate transfer belt 51 manufactured through such a manufacturing method can be polished as required.

The secondary-transfer opposing roller 63 comes into contact with a portion on the front side of the intermediate transfer belt 51 at which the secondary transfer roller 52 is wound around by the intermediate transfer belt 51 to form the secondary transfer nip. Meanwhile, the opposing roller support 64 that rotatably supports itself is moved by a shifting mechanism formed with the second eccentric cam 65, a spring (not shown), and the like, to thus be brought into and out of contact with the intermediate transfer belt 51. During the course of the primary transfer process of superimposing the toner image of each color on the intermediate transfer belt 51, the secondary-transfer opposing roller 63 is separated from the intermediate transfer belt 51. When the superimposing primary transfer process is completed, the secondary-transfer opposing roller 63 is brought into contact with the intermediate transfer belt 51 to form the secondary transfer nip.

The sheet feeder 80 includes a sheet feed cassette 81, and a sheet feed roller 82. The sheet feed cassette 81 houses a plurality of recording sheets P stacked in a batch therein. The sheet feed roller 82 is in contact with a topmost recording sheet P of the sheet batch. The sheet feed roller 82 rotates at a predetermined timing to feed the recording sheet P to the sheet feed path 90.

The sheet feed path 90 is formed of a pair of guide plates facing each other with a predetermined gap therebetween, a transport roller pair 92, the registration roller pair 91, and the like. The sheet feed path 90 nips the recording sheet P fed from the sheet feed cassette 81 between the transport roller pair 92 and transports the recording sheet P vertically upward along the sheet feed path 90. The recording sheet P is then nipped between the registration roller pair 91 positioned near a downstream end of the sheet feed path 90. Immediately after nipping the recording sheet P at a portion near a leading end, the registration roller pair 91 is deactivated to stop rotation. Thereafter the registration roller pair 91 is activated to start rotation at a timing for synchronizing the recording sheet P with the four-color-superimposed toner image on the intermediate transfer belt 51, thereby feeding the recording sheet P to the secondary transfer nip.

In the secondary transfer nip, the four-color-superimposed toner image on the intermediate transfer belt 51 is collectively secondary-transferred onto the recording sheet P fed to the secondary transfer nip in the secondary transfer nip. The four-color-image is combined with a white color of the recording sheet P, thereby forming a full-color image on the recording sheet P. The recording sheet P on which the full-color image is thus formed is fed from the secondary transfer nip to the fuser 95. In advance of the process, the recording sheet P has been charged in the secondary transfer nip. In a course of transportation from the secondary transfer nip to the fuser 95, the recording sheet P comes into contact with a static-eliminating needle 67 fixed to the opposing roller support 64, to thus be diselectrified. This prevents such an inconvenient circumstance that, on the way of transportation to the fuser 95, the recording sheet P that carries a not-yet-fused toner image is excessively charged and damages the not-yet-fused toner image with the excessive charge.

The static-eliminating needle 67 is made of a stainless-steel plate (SUS 301) of 0.2 millimeter thick processed into a saw-toothed shape of which saw pitch is 3 millimeters. A high-voltage power supply (not shown) applies a predetermined static-eliminating bias to the static-eliminating needle 67 at a timing at which the leading end of the recording sheet P starts coming into contact therewith. In place of applying the static-eliminating bias to the static-eliminating needle 67, the static-eliminating needle 67 can be grounded.

In the fuser 95, a fusing roller 95*a* that incorporates a heater such as a halogen lamp, and a pressing roller 95*b* to be pressed against the fusing roller 95*a* are brought into contact with each other to form a fusing nip and rotated. The recording sheet P nipped in the fusing nip is discharged out of the secondary transfer nip and transported. In the course of the transportation, the recording sheet P is subjected to heating, pressing, and the like to have the full-color image fused thereon.

The recording sheet P onto which the full-color image is fused is fed out from the fuser 95, and thereafter discharged to the outside of the image forming apparatus by way of the sheet-discharge roller pair 98.

Secondary-transfer residual toner is sticking onto the surface of the intermediate transfer belt 51 moved past the secondary transfer nip. The secondary-transfer residual toner is removed from the surface of the intermediate transfer belt 51 by the belt cleaner 56 contacting a portion of the intermediate transfer belt 51 at which the tension roller 53 is wound around by the intermediate transfer belt 51. It should be noted that if the belt cleaner 56 is configured to be in constant contact with the intermediate transfer belt 51, the belt cleaner 56 undesirably removes from the intermediate transfer belt 51*a* toner image that is being superimposed in the superimposing primary transfer process that causes the intermediate transfer belt 51 to rotate a plurality of times. To avoid the inconvenience, a shifting mechanism formed with the first eccentric cam 57, or the like, separates the belt cleaner 56 away from the intermediate transfer belt 51 when the superimposing primary transfer process is performed. When the secondary transfer process is started, the belt cleaner 56 is brought into contact with the intermediate transfer belt 51 to remove the secondary-transfer residual toner.

In the superimposing primary transfer process, the primary-transfer-bias power supply 59 applies a primary transfer bias of 700 volts to 1,000 volts to the primary transfer roller 54. Thus, a primary-transfer electric field is formed for electrostatically transferring the negatively-charged toner images from the photosensitive belt 2 onto the primary transfer roller 54 in the primary transfer nip, and the superimposing primary transfer process is performed. More specifically, a primary bias of 700 volts is applied to the primary transfer roller 54 to perform primary transfer of the Y-toner image. To allow for accumulation of charges in the belt, 800 volts, 900 volts, and 1,000 volts are applied to the primary transfer roller 54 to perform primary transfer and superimpose the M, C, and K toner images on one another, respectively.

The mark sensor 58 in the transfer unit 50 detects a reference toner image formed on the intermediate transfer belt 51 for measurement of image-forming performance and the like, and an amount of toner sticking to the intermediate transfer belt 51 per unit area of the reference toner image.

The printer according to the embodiment is capable of performing printing in a monochrome mode for forming a monochrome image of only any one of the four colors of Y, M, C, and K, a two-color mode for forming a two-color image of any two of the four colors, and a three-color mode for forming a three-color image of any three of the same, in addition to a full-color mode for forming a full-color image. Switching among the modes is performed as required based on image data supplied from a personal computer, or the like.

In the monochrome mode, the superimposing primary-transfer process is not performed in the primary transfer nip, but a monochrome toner image having been primary-transferred onto the intermediate transfer belt 51 in the primary transfer nip is secondary-transferred onto the recording sheet P in the secondary transfer nip without returning to the primary transfer nip.

In the two-color mode, a second-color toner image having been primary-transferred and superimposed onto a first-color toner image in the primary transfer nip is secondary-transferred, with the first-color toner image, onto the recording sheet P in the secondary transfer nip without returning to the primary transfer nip.

In the three-color mode, a third-color toner image having been primary-transferred and superimposed onto first-color and second-color toner images in the primary transfer nip is secondary-transferred, with the first-color and second-color toner images, to the recording sheet P in the secondary transfer nip without returning to the primary transfer nip.

Figure 2:
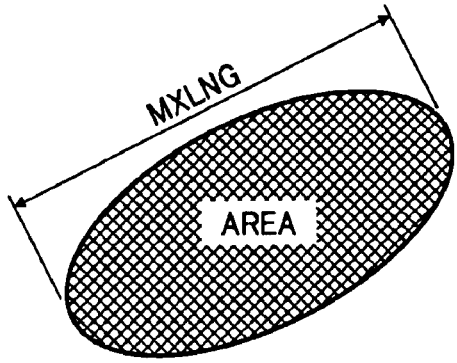
FIG. 2 is a schematic diagram of a toner particle for explaining a shape factor SF-1.
Figure 3:
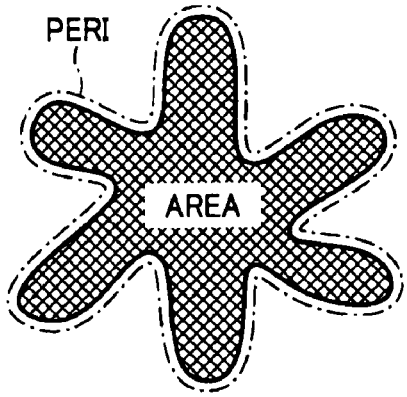
FIG. 3 is another schematic diagram of a toner particle for explaining a shape factor SF-2.

The developing units 8Y, 8M, 8C, and 8K use Y, M, C, and K toners, respectively, of which shape factor SF-1 (first shape factor) falls within the range of 100 to 180 and shape factor SF-2 (second shape factor) falls within in the range of 100 to 180. FIG. 2 is a schematic diagram of a toner particle for explaining the shape factor SF-1. FIG. 3 is another schematic diagram of a toner particle for explaining the shape factor SF-2.

The shape factor SF-1, expressed as: SF-1={(MXLNG)$^2$/AREA}×(100Π/4), represents the degree of roundness of a toner particle. More specifically, the shape factor SF-1 is obtained by projecting a toner particle as shown in FIG. 2 on a two-dimensional plane to obtain a maximum length (MXLNG) and an area of the projected shape. A square of the maximum length (MXLNG) is divided by the area (AREA), and then multiplied by 100Π/4. When a value of the shape factor SF-1 of a toner particle is 100, the toner particle is a true sphere. The greater the SF-1 value, the less roundly the toner particle is shaped.

The shape factor SF-2, expressed as: SF-2={(PERI)$^2$/AREA}×(100Π/4), represents the degree of irregularity of a toner particle. More specifically, the shape factor SF-2 is calculated by dividing a square of a perimeter (PERI) of a projected shape of a toner particle on a two-dimensional plane by an area (AREA) of the shape, and multiplying the result by 100Π/4. When a value of the shape factor SF-2 of a toner particle is 100, a surface of the toner particle has no projections and depressions. The greater the SF-2 value, the more irregularly the surface of the toner particle is formed.

To obtain the shape factors SF-1 and SF-2, a target toner is photographed through a scanning electron microscope (S-800 manufactured by Hitachi, Ltd.), and analyzed using an image analyzer (LUSEX 3 manufactured by NIRECO Corporation). When a toner particle has a shape close to a sphere, contact between toner particles or that between a toner particle and a photosensitive member is made at a point, which weakens adhesion between toner particles, thereby increasing the fluidity of the toner. Because adhesion between the toner and the photosensitive member is also weakened, a transfer efficiency is increased. When any one of the shape factor SF-1 and SF-2 values exceeds 180, the transfer efficiency unfavorably decreases.

As each of the Y, M, C, and K toners, a toner of which volume-average particle size is in the range of 4 to 10 micrometers is employed. When printing is performed using a toner of which volume-average particle size is smaller than 4 micrometers, smear can occur in a not-to-be-printed area, or a white spot can be developed because the toner has poor fluidity and is likely to be agglomerated during development. On the other hand, printing using a toner of which volume-average particle size is greater than 10 micrometer can result in toner scattering or degradation in resolution. A toner of which volume-average particle size is approximately 6.5 micrometers is most preferable.

Polymerised toners produced through polymerization can satisfy the requirements about the shape factors and the volume-average particle size. It is difficult to satisfy the requirements using pulverized toner or other toners; however, pulverized toner can alternatively be employed so long as it is capable of satisfying the requirements.

Referring back to FIG. 1, the photosensitive belt 2, i.e., an image carrier, comes into contact with the front face of the intermediate transfer belt 51 to form the primary transfer nip. The primary-transfer-bias power supply 59 applies a primary transfer bias to the primary transfer roller 54, while the primary transfer roller 54 brings its surface into contact with a vicinity of a back-of-primary-transfer-nip region, which is a portion of an entire region of a rear face of the intermediate transfer belt 51, with respect to a circular moving direction of the intermediate transfer belt 51. The closest distance between the front face of the photosensitive belt 2 and the surface of the primary transfer roller 54 is greater than the thickness of the intermediate transfer belt 51 in and near the primary transfer nip.

If the closest distance between the front face of the photosensitive belt 2 and the surface of the primary transfer roller 54 is set to be equal to the thickness of the intermediate transfer belt 51, the primary transfer roller 54 is perpendicularly pressed against the intermediate transfer belt 51 from the back of the primary transfer nip. To increase a primary-transfer nip pressure in this state, it is necessary to cause the primary transfer roller 54 to press the intermediate transfer belt 51 against the photosensitive belt 2 with strength. When the primary nip pressure is thus increased, the four-layer toner images of the Y, M, C, and K toners are excessively pressed in the primary transfer nip to which a relatively high pressure is applied. This induces a white spot or other defective superimposing transfer.

In contrast, according to the embodiment, the closest distance between the front face of the photosensitive belt 2 and the surface of the primary transfer roller 54 is set to be greater than the thickness of the intermediate transfer belt 51 so that the primary transfer roller 54 is not perpendicularly pressed against the intermediate transfer belt 51 from the back of the primary transfer nip. This decreases the primary-transfer nip pressure as compared with the case where the primary transfer roller 54 is perpendicularly pressed against the photosensitive belt 2 from the back of the primary transfer nip, thereby preventing defective superimposing transfer. More specifically, according to the embodiment, the primary transfer roller 54 is brought into contact with the rear face of the intermediate transfer belt 51 at a position displaced from the back-of-primary-transfer-nip region by 10 millimeters downstream with respect to a moving direction of the belt. The primary transfer roller 54 is prevented from exerting its pressing force on the primary transfer nip, thereby preventing occurrence of defective superimposing transfer resulting from exertion of the pressing force by the primary transfer roller 54. Furthermore, because agglomeration of toners due to the pressure applied in the primary transfer nip is suppressed, an increase in adhesion between the toner image and the intermediate transfer belt 51 is suppressed. This allows to suppress a decrease in efficiency in secondary transfer which can otherwise be caused by the adhesion.

The distance from the back-of-primary-transfer-nip region to the contact portion between the rear face of the intermediate transfer belt 51 and the primary transfer roller 54 is not necessarily 10 millimeters. The distance can be, e.g., 2 millimeters. It should be noted that the distance must be such a value with which the closest distance between the photosensitive belt 2 and the primary transfer roller 54 can be greater than the thickness of the intermediate transfer belt 51.

In the primary transfer nip and a vicinity thereof, a primary transfer current flows from the primary transfer roller 54, to which the primary transfer bias is applied, through the rear face of the intermediate transfer belt 51 in its circumferential direction to the back-of-primary-transfer-nip region, and then flows through the intermediate transfer belt 51 in its thicknesswise direction to the photosensitive belt 2. Thereafter, the primary transfer current flows through the photosensitive belt 2 in its thicknesswise direction to the primary-transfer-nip backup roller 5, and eventually be grounded. When the primary transfer roller 54 is brought into contact with the intermediate transfer belt 51 at a position displaced from the back-of-primary-transfer-nip region, it is necessary to cause the primary transfer current out of the primary transfer roller 54 to flow in the circumferential direction of the belt toward the primary transfer nip. The primary transfer roller 54 is in contact with the intermediate transfer belt 51 at the position downstream of the back-of-primary-transfer-nip region with respect to the moving direction of the belt rather than a position upstream thereof to avoid an increase in electric field strength in a neighborhood of a nip-starting area of the primary transfer nip which can otherwise be caused when the primary transfer current flows to the neighborhood of the nip-starting area. This suppresses transfer dusts formed with toner particles dislodged from the photosensitive belt 2 and scattered toward the intermediate transfer belt 51 by the electric field upstream of the primary transfer nip. When toner that is less easily scattered through gaps is employed, the primary transfer roller 54 can be in contact with the intermediate transfer belt 51 at a position upstream of the back-of-primary-transfer-nip region with respect to the moving direction of the belt.

Because the intermediate transfer belt 51 is required to allow the primary transfer current to be conducted through the rear face in the circumferential direction of the belt, a belt of which surface resistivity on the rear face is adjusted to $10^9\Omega/\square$ to $10^{11}\Omega/\square$ is employed as the intermediate transfer belt 51. This is because, when the surface resistivity is lower than $10^9\Omega/\square$, the primary transfer current undesirably flows from the primary transfer roller 54 to the ground via one of the rollers (e.g., the secondary transfer roller 52) that stretch the intermediate transfer belt 51 therearound. As a result, defective primary transfer is increasingly likely to occur due to an insufficient primary transfer current in the primary transfer nip. By contrast, when the surface resistivity is greater than $10^{11}\Omega/\square$, the primary transfer current is insufficiently supplied to the primary transfer nip because the primary transfer current less easily flows through the intermediate transfer belt 51 in the circumferential direction. In an experiment performed using the printer including the intermediate transfer belt 51 of which surface resistivity was greater than $10^{11}\Omega/\square$, even when the primary transfer bias of 1,800 volts was applied to the primary transfer roller 54, the primary transfer current measured in the primary transfer nip was as small as 2 microamperes. A similar experiment was performed while gradually decreasing the distance between the primary transfer roller 54 and a nip-ending area in the primary transfer nip, however, even when the distance was decreased to as small as 2 millimeters, the primary transfer current in the primary transfer nip remained to be insufficient. When the primary transfer bias was further increased in this state, electric discharge occurred between the primary transfer roller 54 and the intermediate transfer belt 51. This discharge caused the toner image on the intermediate transfer belt 51 to be reversely charged, and produces a partial transfer void. Another similar experiment using the intermediate transfer belt 51 of which surface resistivity was adjusted to $10^{11}\Omega/\square$ was performed. When the primary transfer bias of 1,800 volts was applied to the primary transfer roller 54, a sufficient amount of the primary transfer current was successfully supplied to the primary transfer nip.

The volume resistivity and surface resistivity were measured as follows. An HRS probe (diameter of inner electrode: 5.9 millimeters, inside diameter of ring electrode: 11 millimeters) was connected to a high resistively meter (HIRESTA IP manufactured by Mitsubishi Chemical Corporation), and 100 volts (surface resistance: 500 volts) was applied to the intermediate transfer belt 51 across the front and rear faces thereof. After 10 seconds, volume resistivity and surface resistivity values were obtained.

The secondary transfer roller 52 stretches the intermediate transfer belt 51 at a region behind the secondary transfer nip, and functions as the second contacting member that brings its surface into contact with a backside region of the secondary transfer nip, which is a portion of the entire region of the rear face of the intermediate transfer belt 51 with respect to the moving direction of the intermediate transfer belt 51. The secondary-transfer opposing roller 63 comes into contact with a portion on the front face of the intermediate transfer belt 51, at which the intermediate transfer belt 51 forms the secondary transfer nip with the secondary transfer roller 52.

When the recording sheet P nipped in the secondary transfer nip is decreased in resistance, the secondary transfer current undesirably leaks from the recording sheet P via the registration roller pair 91 because the registration roller pair 91 is grounded. This can cause an undercurrent of the secondary transfer current. To attain favorable secondary transfer, approximately 30 microamperes of the secondary transfer current in absolute value is desirably supplied to the secondary transfer nip.

Therefore, according to the embodiment, the secondary transfer bias is applied to the secondary transfer roller 52 rather than to the secondary-transfer opposing roller 63. Because the negatively-charged toner and the secondary transfer roller 52 are required to repel each other, the secondary-transfer-bias power supply 62 applies a bias of negative polarity the same as that of the toner to the secondary transfer roller 52. When the printer is configured as described above, the secondary transfer current flows to the negatively-charged secondary transfer roller 52. More specifically, the secondary transfer current passes through two current paths: a first path and a second path. Along the first path, the secondary transfer current flows from the grounded secondary-transfer opposing roller 63 through the recording sheet P and the intermediate transfer belt 51 in their thicknesswise directions, respectively, into the secondary transfer roller 52. Along the second path, the secondary transfer current flows from the grounded registration roller pair 91 through the recording sheet P along the sheet plane and then through the intermediate transfer belt 51 in its thicknesswise direction into the secondary transfer roller 52. Any one of the paths causes the second transfer current between the recording sheet P and the intermediate transfer belt 51 in its thicknesswise direction. Therefore, even when moisture absorption by the recording sheet P increases the amount of current passing through the second path, a total amount of the second transfer current supplied to the secondary transfer nip remains unchanged. Accordingly, even when the recording sheet P absorbs moisture, a sufficient amount of the secondary transfer current is supplied to flow from the recording sheet P to the intermediate transfer belt 51, thereby suppressing occurrence of defective transfer in the secondary transfer nip resulting from the moisture absorption by the recording sheet P.

As the secondary transfer roller 52, a roller made by covering a metal core of a stainless steel or the like with a conductive elastic layer is used. The conductive elastic layer is formed with a material obtained by dispersing a conductive material in an elastic material such as a urethane. The secondary transfer roller 52 is adjusted to have an electrical resistance in the range of $10^6$ to $10^{10}$ ohms. When a roller of which electric resistance is greater than $10^{10}$ ohms is employed as the secondary transfer roller 52, a value of the secondary transfer bias required to obtain the required secondary transfer current sharply increases, which increases cost for the power supply. Furthermore, because a need of high voltage application arises, white spots are likely to be produced on a halftone image due to discharge through gaps near the secondary transfer nip. On the other hand, when a roller of which electric resistance is smaller than $10^6$ ohms is employed as the secondary transfer roller 52, it is difficult to attain efficient secondary transfer for both a multi-color image portion (e.g., an image on which three colors are superimposed) on an image and that for a monochrome image portion of the same image. The reason therefor is described below. Because the secondary transfer roller 52 is low in electric resistance, a sufficient amount of the secondary transfer current for the monochrome image portion can be ensured with a relatively-low secondary transfer bias. On the other hand, the multi-color image portion requires a higher voltage than an optimum voltage for the monochrome image portion. When the secondary transfer voltage is set to such a value that attains favorable secondary transfer of the multi-color image portion, an excessive amount of the secondary transfer current is supplied for the monochrome image, which reduces the transfer efficiency.

The electric resistance across the secondary transfer roller 52 was measured as follows. The secondary transfer roller 52 was placed on a conductive metal plate. While a load of 4.9 newtons was applied to each side (a total of 9.8 newtons) of a metal core of the secondary transfer roller 52, 1,000 volts was applied across the metal core and the metal plate, and a current value at this time was measured. The value of the electric resistance was calculated based on the current value.

The secondary transfer roller 52 to be driven through a gear (not shown) fixed to one end of the metal core is adjusted to rotate at an essentially identical peripheral velocity with that of the intermediate transfer belt 51.

As the primary transfer roller 54, a metal roller the entire of which is formed with a metal material, such as a stainless steel, is used. When the primary transfer roller 54 has such a configuration, an outer diameter of a roller section of the primary transfer roller 54 is less easily changed than that formed with an elastic material such as a urethane foam or a rubber. Thus, fluctuation in pressing force against the primary transfer nip can be prevented, which can otherwise be caused by fluctuation in outer diameter. Hence, the primary transfer nip can be continuously maintained at a lower pressure stably. When the primary transfer roller 54 is positioned at a considerably great distance from the primary transfer nip, influences which can otherwise be imparted by fluctuations in the outer diameter on the primary-transfer nip pressure can be prevented. Therefore, a roller covered with a conductive resin of which electric resistance is relatively low can alternatively be employed.

As described above, as the secondary-transfer roller 52 being one of the roller members is rotated by the driving unit (not shown) counterclockwise in FIG. 1, the intermediate transfer belt 51 endlessly moves counterclockwise in FIG. 1. This imparts a driving force to the intermediate transfer belt 51 at the back of the secondary transfer nip, thereby stabilizing a peripheral velocity of the intermediate transfer belt 51 in the secondary transfer nip. More specifically, when the recording sheet P advances into the secondary transfer nip, a load applied to the intermediate transfer belt 51 increases sharply. When a roller that is in contact with the rear face of the intermediate transfer belt 51 at a position separated from the secondary transfer nip by a relatively large distance is used as a drive roller, the sharp increase in the load can result in abrupt fluctuations in a tension of the intermediate transfer belt 51, thereby easily decreasing the surface velocity of the intermediate transfer belt 51 in the secondary transfer nip sharply. In contrast, when the secondary transfer roller 52 on the back of the secondary transfer nip is used also as a drive roller, the increase in the load applied to the intermediate transfer belt 51 is directly received by the secondary transfer roller 52. This suppresses a decrease in the surface velocity of the intermediate transfer belt 51 in the secondary transfer nip caused by the fluctuations in tension of the intermediate transfer belt 51.

In the printer, the primary transfer roller 54 to which the primary transfer bias of the polarity opposite to that of the toner is located at a position displaced from the back-of-primary-transfer-nip region. Accordingly, it is necessary to employ a belt through which the primary transfer current can flow in the circumferential direction of the belt as the intermediate transfer belt 51. As for the secondary transfer process, the secondary transfer bias of the same polarity as that of the toner is applied to the secondary transfer roller 52 contacting the rear face of the intermediate transfer belt 51 to suppress defective secondary transfer resulting from moisture absorption by the recording sheet P. In the printer of such a configuration, the primary transfer bias and the secondary transfer bias having opposite polarities can interfere with each other and exert adverse influences. More specifically, an electric current can be conducted from the positively-charged primary transfer roller 54 to the negatively-charged secondary transfer roller 52 in the circumferential direction of the belt. This undesirable flow of the electric current from the primary transfer roller 54 to the secondary transfer roller 52 adversely affects the secondary transfer process. Furthermore, because an electric current flowing from the primary transfer roller 54 to the secondary transfer roller 52 is generated, the primary transfer current undesirably decreases. The decrease in the primary transfer current can be suppressed by setting the primary transfer bias to a higher value to allow for an amount of the electric current flowing to the secondary transfer roller 52 in advance. However, because an electric resistance of the intermediate transfer belt 51 varies on a product-by-product basis, an amount of the electric current flowing through the same also varies on a product-by-product basis. The greater the distance between the primary transfer roller 54 and the secondary transfer roller 52, the greater the variation in the amount of the electric current increases. This makes it difficult to predict the amount of electric current flowing into the secondary transfer roller 52 in advance.

To solve the problem, in the printer, the conductive grounded roller 55 is brought into contact with the intermediate transfer belt 51 at a position between a contact portion between the rear face of the intermediate transfer belt 51 and the primary transfer roller 52 and that between the rear face and the secondary transfer roller 52. The conductive grounded roller 55 is grounded. When the printer has such a configuration, the electric current flowing from the primary transfer roller 54 circumferentially through the rear face of the intermediate transfer belt 51 to the secondary transfer roller 52 flows into the ground via the grounded roller 55. This prevents the electric current from flowing from the primary transfer roller 54 to the secondary transfer roller 52 circumferentially through the intermediate transfer belt 51. Hence, adverse influences which can otherwise be exerted on the secondary transfer process due to the electric current flowing from the primary transfer roller 54 into the secondary transfer roller 52 can be prevented. A part of the primary transfer current is conducted through the belt in the circumferential direction to flow into the grounded roller 55, producing a loss in the primary transfer current. However, because the distance between the primary transfer roller 54 and the grounded roller 55 is shorter than that between the primary transfer roller 54 and the secondary transfer roller 52, variations in an amount of the current loss due to the variations in resistance of the intermediate transfer belt 51 are suppressed. This increases the ease of prediction about the amount of the current loss of the primary transfer current.

The present inventors measured an amount of electric current flowing from the grounded roller 55 to the secondary transfer roller 52 in the following conditions: as the intermediate transfer belt 51, a belt of which surface resistivity was adjusted to $10^{11}\Omega/\square$ was mounted on the printer; and the value of the secondary transfer bias was set to a value with which favorable secondary transfer was to be attained. It measured that the amount of the electric current flowing from the grounded roller 55 to the secondary transfer roller 52 was equal to or smaller than 5% of a total amount of the secondary transfer current (in this example, −30 microamperes) flowing into the secondary transfer roller 52. When the amount of the electric current is at such a low level, defective secondary transfer does not occur due to a decrease in the amount of the secondary transfer current. A similar experiment was performed using a belt of which surface resistivity was $10^{9}\Omega/\square$ as the intermediate transfer belt 51. It measured that the amount of the electric current flowing from the grounded roller 55 to the secondary transfer roller 52 via the belt was equal to or smaller than 30% of the total amount of the secondary transfer current flowing into the secondary transfer roller 52. When the amount of the electric current is at such a low level, approximately 90% of the secondary transfer efficiency can be ensured, posing no severe problem. However, in a similar experiment performed using a belt of which surface resistivity was $10^{8.7}\Omega/\square$ as the intermediate transfer belt 51, it measured that the amount of the electric current flowing from the grounded roller 55 to the secondary transfer roller 52 via the belt reached 50% of the total amount of the secondary transfer current flowing into the secondary transfer roller 52. Under such a state, the secondary transfer efficiency falls below 80% of an intended efficiency, and can highly possibly induce defective secondary transfer. From the above results of the experiments, a belt of which surface resistivity falls within the range of $10^{9}\Omega/\square$ to $10^{11}\Omega/\square$ is desirably employed as the intermediate transfer belt 51.

The primary-transfer bias controller 60 is connected to the primary-transfer-bias power supply 59. The primary-transfer bias controller 60 controls the voltage output from the primary-transfer-bias power supply 59 so that a value of the electric current output from the primary-transfer-bias power supply 59 attains a predetermined value. The secondary-transfer bias controller 61 is connected to the secondary-transfer-bias power supply 62. The secondary-transfer bias controller 61 controls the voltage output from the secondary-transfer-bias power supply 62 so that a value of the electric current output from the secondary-transfer-bias power supply 62 attains a predetermined value.

Meanwhile, the ammeter 66 that detects an amount of electric current flowing between the intermediate transfer belt 51 and the grounded roller 55 is connected between the grounded roller 55 and the ground lead. Each of the primary-transfer bias controller 60 and the secondary-transfer bias controller 61 corrects a target value for the electric current output from corresponding one of the power supplies based on a result of detection performed by the ammeter 66.

Figure 4:
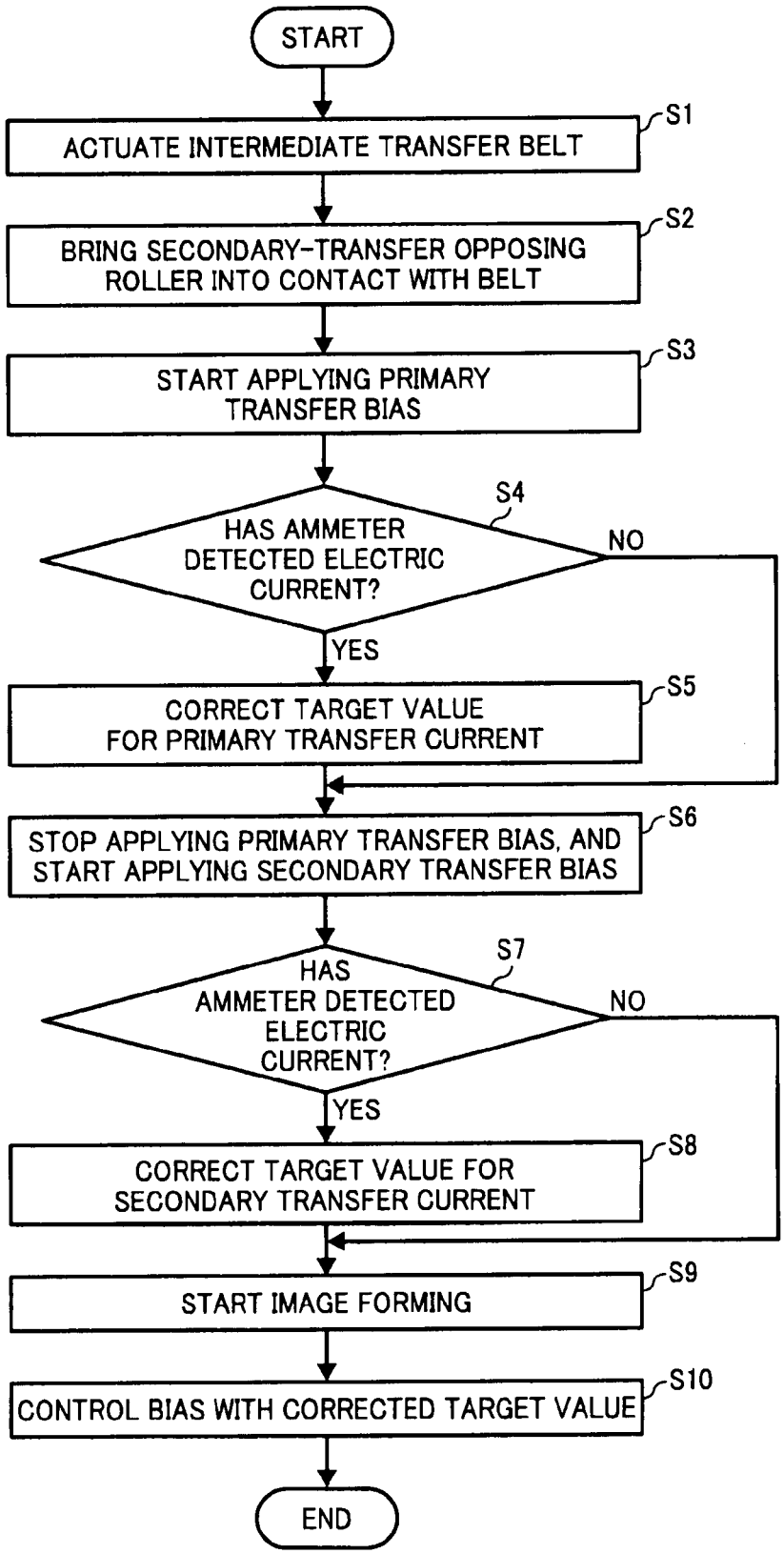
FIG. 4 is a flowchart of a bias controlling process performed by the image forming apparatus.

More specifically, as shown in FIG. 4, when a print job starts, a main controller (not shown) of the printer actuates the intermediate transfer belt 51 (step S1). Thereafter, the secondary-transfer opposing roller 63 is brought into contact with the intermediate transfer belt 51 to form the secondary transfer nip (step S2). Subsequently, the primary-transfer bias controller 60 causes the primary-transfer-bias power supply 59 to output primary transfer bias, and simultaneously, controls the primary transfer bias so that the electric current output from the primary-transfer-bias power supply 59 attains a predetermined target value based on a signal supplied from the main controller (step S3). The main controller determines whether the ammeter 66 connected thereto has detected an electric current. When no electric current has been detected by the ammeter 66 (No at step S4), the process control moves to step S6. When an electric current has been detected by the ammeter 66 (YES at step S4), the main controller outputs a signal indicating a value of the detected current to the primary-transfer bias controller 60. The primary-transfer bias controller 60 corrects, based on the signal, the target value for the primary transfer bias to be supplied from the primary-transfer-bias power supply 59 by adding the detected current value to the target value or the like (step S5). The main controller then causes the primary-transfer bias power supply 59 to stop applying the primary transfer bias (step S6).

Subsequently, the secondary-transfer bias controller 61 causes the secondary-transfer-bias power supply 62 to output secondary transfer bias, and simultaneously, controls the secondary transfer bias such that the electric current output from the secondary-transfer-bias power supply 62 attains a predetermined target value based on a signal supplied from the main controller (step S6). The main controller determines whether the ammeter 66 has detected an electric current (step S7). When no electric current is detected by the ammeter 66 (NO at step S7), the process control moves to step S9. When an electric current has been detected by the ammeter 66 (YES at step S7), the main controller outputs a signal indicating a value of the detected current to the secondary-transfer bias controller 61. The secondary-transfer bias controller 61 corrects, based on the signal, the target value for the secondary transfer bias to be supplied from the secondary-transfer-bias power supply 62 by adding the detected current value to the target value or the like (step S8). When the main controller starts forming an image (step S9), the primary-transfer bias controller 60 and the secondary-transfer bias controller 61 control the primary transfer bias and the secondary transfer bias to the corrected target values, respectively (step S10).

As just described, the target values for the primary transfer current and the secondary transfer current are set to include losses due to current leakage between the grounded roller 55 and the intermediate transfer belt 51. This allows to supply approximately target amounts of electric current to the primary-transfer nip area and the secondary transfer nip, respectively. Hence, occurrence of defective primary transfer and defective secondary transfer due to losses of the primary and secondary transfer currents resulting from leakage of the currents between the grounded roller 55 and the intermediate transfer belt 51 can be suppressed.

Meanwhile, when the bias is under a constant-voltage control, controlling the target value for the bias in accordance with the amount of losses yields the similar effect.

Both the primary-transfer-bias power supply 59 that supplies the primary transfer bias to the primary transfer roller 54 and the secondary-transfer-bias power supply 62 that supplies the secondary transfer bias to the secondary transfer roller 54 are located in a loop formed by the intermediate transfer belt 51. This downsizes the image forming apparatus as compared with that in which the power supplies are provided outside the loop. When the primary-transfer-bias power supply 59 and the secondary-transfer-bias power supply 62, and the transfer unit 50 are configured to be removable with respect to a main body of the image forming apparatus, replacement of power supplies is also facilitated.

In the printer, the rollers 54 and 52 are employed as the first and second contacting members, respectively. Each of the contacting members can be a rotator such as a rotating brush other than a rotating brush, or an unrotatable brush, blade or plate.

Figure 5:
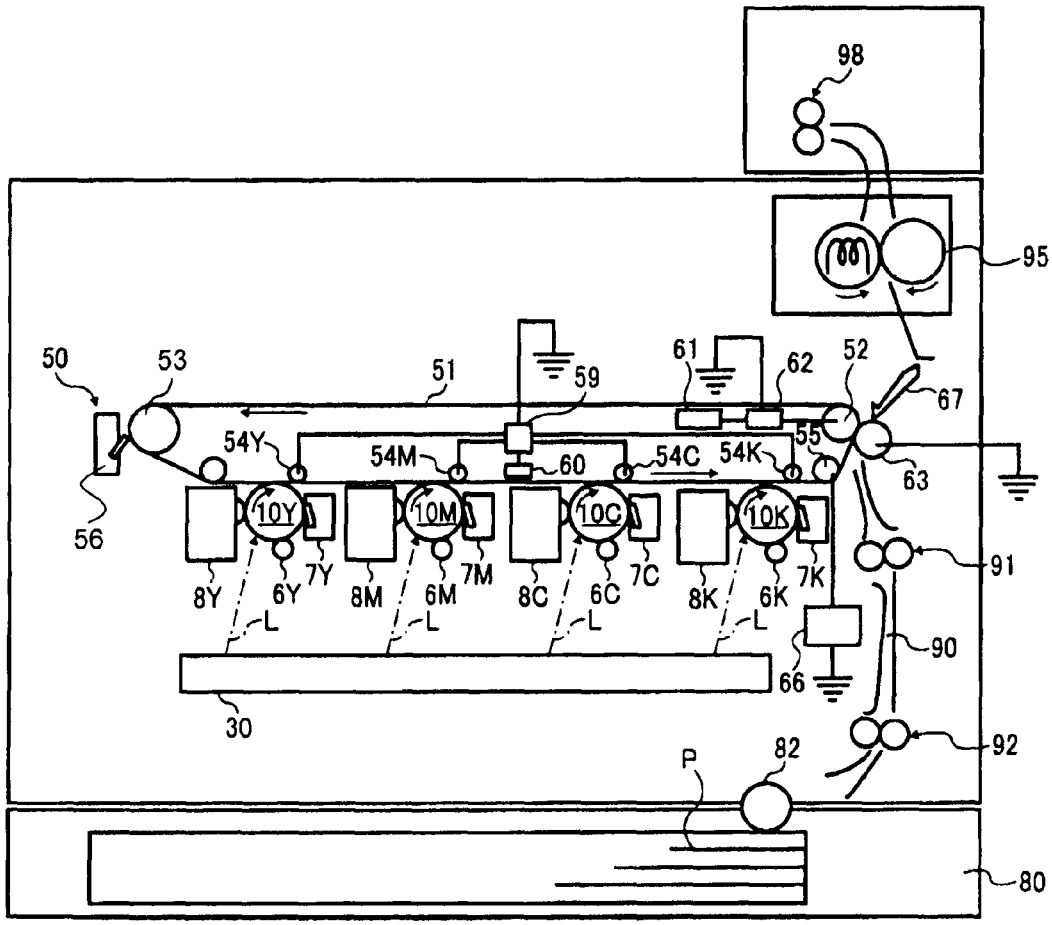
FIG. 5 is a schematic diagram of an image forming apparatus according to a modification of the embodiment.

FIG. 5 is a schematic diagram of a printer according to a modification of the embodiment. The printer according to the embodiment is provided with only a single primary transfer nip formed between the photosensitive belt 2 and the intermediate transfer belt 51 contacting each other. In contrast, the printer of the modification is provided with four primary transfer nips formed between four photosensitive members 10Y, 10M, 10C, and 10K and an intermediate transfer belt 51. Otherwise, the printer of the modification is of basically the same configuration and operates in the same manner as that according to the embodiment described above.

The transfer unit 50 causes the intermediate transfer belt 51 to rotate counterclockwise in FIG. 5 while stretching the intermediate transfer belt 51 in a landscape orientation to be longer in a horizontal direction than in a vertical direction. A lower stretched face of the intermediate transfer belt 51 extends in an essentially horizontal direction. Four processing units for the Y, M, C, and K toners, i.e., Y, M, C, and K processing units are horizontally arranged below the lower stretched face. Each of the Y, M, C, and K processing units brings corresponding one of the photosensitive members 10Y, 10M, 10C, and 10K into contact with the front face of the intermediate transfer belt 51 to form the primary transfer nip for corresponding one of the Y, M, C, and K toners.

Except for colors of the toners used, the Y, M, C, and K processing units are of essentially like configuration, and thus but one of them, the Y processing unit that forms a Y-toner image is described as an example. The Y processing unit includes the drum-shaped photosensitive member 10Y, the developing unit 8Y, a photosensitive member cleaner 7Y, and a charging roller 6Y held in the same holder, and detachably attached to a main body of the printer.

The charging roller 6Y to which a charging bias is applied from a power supply (not shown) is rotated by a drive unit (not shown) and brought into contact with the photosensitive member 10Y. The charging roller 6Y discharges electricity at and near a contact portion between the charging roller 6Y and the photosensitive member 10Y, thereby negatively uniformly charging the photosensitive member 10Y. In place of the charging roller 6Y, a charging brush can alternatively be brought into contact with the photosensitive member 10Y. Further alternatively, a charger such as a scorotron charger capable of uniformly charging the photosensitive member 10Y can be employed.

The surface of the photosensitive member 10Y is thus uniformly charged by the charging roller 6Y, and then scanned and exposed by a laser beam L emitted from an optical writing unit 30 to carry an electrostatic latent image for Y thereon. The electrostatic latent image is developed by the developing unit 8Y into the Y-toner image, and thereafter primary-transferred onto the intermediate transfer belt 51 in a primary transfer nip for Y formed between the photosensitive member 10Y and the intermediate transfer belt 51 contacting each other.

Transfer residual toner sticking to the surface of the photosensitive member 10Y past through the primary transfer nip for Y is removed by the photosensitive member cleaner 7Y.

The M processing unit is located to the right of the Y processing unit in FIG. 5. The M processing unit forms an M-toner image on the photosensitive member 10M through the same process as described previously for the Y processing unit. The M-toner image is transferred and superimposed onto the Y-toner image on the intermediate transfer belt 51 in the primary transfer nip for M formed between the photosensitive member 10M and the intermediate transfer belt 51 contacting each other.

The C processing unit is located to the right of the processing unit for M in FIG. 5. The C processing unit forms a C-toner image on the photosensitive member 10C through the same processes. The C-toner image is transferred and superimposed onto the Y- and M-toner images on the intermediate transfer belt 51 in the primary transfer nip for C formed between the photosensitive member 10C and the intermediate transfer belt 51 contacting each other.

The K processing unit is located to the right of the C processing unit in FIG. 5. The K processing unit forms a K-toner image on the photosensitive member 10K through the same processes. The K-toner image is transferred and superimposed onto the Y-, M-, and C-toner images on the intermediate transfer belt 51 in the primary transfer nip for K formed between the photosensitive member 10K and the intermediate transfer belt 51 contacting each other.

The thus-formed four-color-superimposed toner image on the intermediate transfer belt 51 is collectively secondary-transferred onto a recording sheet P in the secondary transfer nip formed between the intermediate transfer belt 51 and a secondary-transfer opposing roller 63 contacting each other. The four-color-superimposed toner image is combined with a white color of the recording sheet P, thereby forming a full-color image on the recording sheet P.

Four primary transfer rollers 54Y, 54M, 54C, and 54K for the Y, M, C, and K toners are provided in the loop formed by the intermediate transfer belt 51 near the primary transfer nips for the Y, M, C, and K toners, respectively. As in the case of the printer according to the embodiment, each of the primary transfer rollers 54Y, 54M, 54C, and 54K is provided at a position displaced from corresponding one of back-of-primary-transfer-nip regions only by approximately 10 millimeters upstream in the belt moving direction such that each of closest distances between the primary transfer rollers 54Y, 54M, 54C, and 54K and the photosensitive members 10Y, 10M, 10C, and 10K is greater than the thickness of the intermediate transfer belt 51.

In the printer of the modification, as in the case of the printer according to the embodiment, the secondary transfer bias of the same polarity as that of the toner is applied to the secondary transfer roller 52 contacting the back-of-secondary-transfer-nip region on the intermediate transfer belt 51.

Primary transfer biases are independently supplied to the primary transfer rollers 54Y, 54M, 54C, and 54K from primary-transfer-bias power supplies, respectively. However, when differences in amounts of losses of the primary transfer currents caused by leakage to the grounded roller 55 are small, the primary transfer bias of the same value can be applied to the primary transfer rollers 54Y, 54M, 54C, and 54K.

According to the embodiment, a metal roller is used as the primary transfer roller 54. Therefore, as described above, an outer diameter of the roller section is less likely to change than that formed with an elastic material such as a urethane foam or a rubber. Accordingly, the primary transfer nip can be stably maintained at a lower pressure continuously.

Besides, a roller member is used as the secondary transfer roller 52, and the drive unit is provided to rotate the roller member to thereby cause the intermediate transfer belt 51 to endlessly move. This, as described above, imparts a driving force to the intermediate transfer belt 51 at the back of the secondary transfer nip, thereby stabilizing a peripheral velocity of the intermediate transfer belt 51 in the secondary transfer nip.

The printer includes the grounded roller 55 that comes into contact with the rear face of the intermediate transfer belt 51 at the position between the contact portion between the intermediate transfer belt 51 and the secondary transfer roller 52 and that between the rear face and the secondary transfer roller 52. The grounded roller 55 is grounded. This prevents, as described above, adverse influences which can otherwise be exerted on secondary transfer due to the electric current flowing from the primary transfer roller 54 into the secondary transfer roller 52. As a result, prediction can be facilitated about the amount of the current loss of the primary transfer current.

The printer includes the ammeter 66 that detects an amount of electric current flowing between the rear face of the intermediate transfer belt 51 and the grounded roller 55. The printer also includes the primary-transfer bias controller 60 and the secondary-transfer bias controller 61 that control the primary transfer bias to be applied to the primary transfer roller 54 and the secondary transfer bias to be applied to the secondary transfer roller 52, respectively, based on a result of detection performed by the ammeter 66. With this configuration, as described above, the target values for the primary transfer current and the secondary transfer current are determined to include losses due to current leakage between the grounded roller 55 and the intermediate transfer belt 51. This allows the approximately target amount of electric current to flow through each of the primary-transfer nip and the secondary transfer nip, thereby suppressing defective primary transfer and defective secondary transfer resulting from the losses in the primary transfer current and the secondary transfer current.

The primary-transfer-bias power supply 59 that supplies the primary transfer bias to be applied to the primary transfer roller 54 and the secondary-transfer-bias power supply 62 that supplies the secondary transfer bias to be applied to the secondary transfer roller 52 are located in the loop formed by the intermediate transfer belt 51. This downsizes the image forming apparatus as compared to that in which the power supplies are provided outside the loop.

According to an embodiment of the present invention, the closest distance between the surface of the image carrier and the surface of the first contacting member is set to be greater than the thickness of the intermediate transfer belt to avoid such a circumstance that the first contacting member is undesirably perpendicularly pressed against the image carrier from the back of the first transfer nip. This configuration allows to reduce a pressure applied to the first transfer nip as compared with that of a configuration in which the first contacting member is perpendicularly pressed against the image carrier from the back of the first transfer nip. Hence, defective superimposing transfer that can occur when an overpressure is applied to the multi-layered toner images in the superimposing transfer process can be suppressed.

Meanwhile, the transfer bias is applied to the second contacting member that comes into contact with the back-of-second-transfer-nip region or the vicinity thereof on the rear face of the intermediate transfer belt rather than to the second-transfer-nip forming member that comes into contact with the front face of the intermediate transfer belt to form the secondary transfer nip so that the transfer current out of the secondary contacting member flows into the second-transfer-nip forming member through the intermediate transfer belt and the recording medium nipped in the secondary transfer nip. According to the configuration, even when leakage of the transfer current out of the recording medium, of which resistance is decreased due to moisture absorption, through the guide member or the like occurs, the transfer current flows from the intermediate transfer belt to the recording medium in the second transfer nip located upstream of the contact portion between the recording medium and the guide member and the like without fail. Thus, the occurrence of defects at the secondary transfer nip due to moisture absorption by the recording medium can be suppressed.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer device comprising:

an intermediate transfer member that moves endlessly;

an image carrier that comes into contact with an outer surface of the intermediate transfer member to form a first transfer nip;

a first contacting member that is applied with a first transfer bias and that comes in contact with an inner surface of the intermediate transfer member in the first transfer nip or near the first transfer nip;

a second transfer nip forming member that comes into contact with the outer surface of the intermediate transfer member to form a second transfer nip; and a second contacting member that is applied with a second transfer bias and that comes into contact with the inner surface of the intermediate transfer member in the second transfer nip or near the second transfer nip, wherein a closest distance between a surface of the image carrier and a surface of the first contacting member is greater than a thickness of the intermediate transfer member, and a toner image on the image carrier is transferred directly onto the intermediate transfer member, or transferred onto a toner image that has already been transferred onto the intermediate transfer member to form a superimposed toner image on the intermediate transfer member, and the superimposed toner image on the intermediate transfer member is transferred onto a recording medium at the second transfer nip.

2. The transfer device according to claim 1, wherein the first contacting member is a metal roller.

3. The transfer device according to claim 1, wherein the second contacting member is a roller, the transfer device further comprising:

a drive unit that rotates the roller to cause the intermediate transfer member to endlessly move.

4. The transfer device according to claim 1, further comprising a third contacting member that is conductive and comes into contact with the inner surface of the intermediate transfer member at a position between the first transfer nip and the second transfer nip, wherein the third contacting member is grounded.

5. The transfer device according to claim 4, further comprising:

a detecting unit that detects an amount of electric current flowing between the inner surface of the intermediate transfer member and the third contacting member; and a control unit that controls at least one of the first transfer bias and the second transfer bias based on an output of the detecting unit.

6. The transfer device according to claim 1, further comprising:

a first power supply that supplies the first transfer bias, and is located in a loop formed by the intermediate transfer member; and a second power supply that supplies the second transfer bias, and is located in the loop.

7. The transfer device according to claim 1, wherein a volume resistivity of the intermediate transfer member ranges from $10^8$ Ω/cm to $10^{12}$ Ω/cm; and a surface resistivity of the inner surface of the intermediate transfer member ranges from $10^9$Ω/□ to $10^{11}$Ω/□.

8. An image forming apparatus comprising the transfer device according to claim 1.

9. The image forming apparatus according to claim 8, wherein the toner image is formed using toner with a first shape factor in a range of 100 to 180 and a second shape factor in a range of 100 to 180.

10. The image forming apparatus according to claim 9, wherein the toner is a polymerized toner produced by polymerization.

11. The transfer device according to claim 1, wherein:

the first contacting member comes in contact with an inner surface of the intermediate transfer member within 10 millimeters of the first transfer nip.

12. The transfer device according to claim 1, wherein:

the second contacting member comes into contact with the inner surface of the intermediate transfer member within 10 millimeters of the second transfer nip.

13. The transfer device according to claim 1, wherein:

the first contacting member comes in contact with an inner surface of the intermediate transfer member within 10 millimeters of the first transfer nip, and the second contacting member comes into contact with the inner surface of the intermediate transfer member within 10 millimeters of the second transfer nip.

14. The transfer device according to claim 1, wherein:

near is approximately 10 millimeters.

* * * * *